US008517113B2

(12) United States Patent
Sheffield

(10) Patent No.: US 8,517,113 B2
(45) Date of Patent: Aug. 27, 2013

(54) REMOTELY ACTUATING A VALVE

(75) Inventor: Randolph J. Sheffield, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 1337 days.

(21) Appl. No.: 10/905,196

(22) Filed: Dec. 21, 2004

(65) Prior Publication Data

US 2006/0131030 A1 Jun. 22, 2006

(51) Int. Cl.
*E21B 34/00* (2006.01)
*E21B 34/06* (2006.01)

(52) U.S. Cl.
CPC ..... *E21B 34/066* (2013.01)
USPC ..... 166/373; 166/386; 166/66.6; 166/332.1; 340/853.1; 340/854.3

(58) Field of Classification Search
USPC ..... 166/372, 373, 386, 316, 332.1, 66, 166/66.6; 340/853.1, 854.3
See application file for complete search history.

(56) References Cited

U.S. PATENT DOCUMENTS

| | | | | |
|---|---|---|---|---|
| 4,617,960 | A | 10/1986 | More | |
| 4,796,708 | A | 1/1989 | Lembcke | |
| 4,953,616 | A | 9/1990 | Borden et al. | |
| 5,273,112 | A * | 12/1993 | Schultz | 166/374 |
| 5,531,270 | A | 7/1996 | Fletcher et al. | |
| 5,975,204 | A * | 11/1999 | Tubel et al. | 166/66.6 |
| 6,000,468 | A * | 12/1999 | Pringle | 166/66 |
| 6,216,784 | B1 | 4/2001 | Harrell | |
| 6,494,265 | B2 | 12/2002 | Wilson et al. | |
| 6,758,277 | B2 * | 7/2004 | Vinegar et al. | 166/372 |
| 6,920,085 | B2 * | 7/2005 | Finke et al. | 340/853.1 |
| 6,958,704 | B2 * | 10/2005 | Vinegar et al. | 340/854.3 |
| 7,073,594 | B2 * | 7/2006 | Stegemeier et al. | 166/373 |
| 7,108,073 | B2 * | 9/2006 | Patel | 166/386 |
| 7,347,275 | B2 * | 3/2008 | Fontenot et al. | 166/386 |
| 7,370,705 | B2 * | 5/2008 | Jones et al. | 166/386 |
| 7,397,388 | B2 * | 7/2008 | Huang et al. | 340/854.3 |
| 7,503,398 | B2 * | 3/2009 | LoGiudice et al. | 166/386 |

FOREIGN PATENT DOCUMENTS

WO 00/33492 A1 6/2000

* cited by examiner

*Primary Examiner* — Joshua J Michener
*Assistant Examiner* — Matthew J Smith
(74) *Attorney, Agent, or Firm* — David Groesbeck; Brandon S. Clark

(57) ABSTRACT

A technique that is usable with a subterranean well includes communicating a wireless stimulus in the well. The technique includes actuating a valve in response to the communication. The valve has more than one controllable open position.

24 Claims, 5 Drawing Sheets

REMOTELY ACTUATING A VALVE

BACKGROUND

The invention generally relates to remotely actuating a valve, such as a multi-position valve or a variable orifice sleeve valve, as examples.

A typical subterranean well may include various valves to perform different downhole functions. A valve may be temporary in nature for purposes of testing the well; and for a completed well, a particular valve may be permanently installed to control a downhole flow rate or pressure in the well.

Some valves, such as conventional flapper valves and ball valves, have only two controllable positions: an open position that presents a fixed cross-sectional flow area; and a closed position in which the valve blocks fluid from passing through the valve. Other valves have variable cross-sectional flow paths, and thus, these valves have more than one controllable open position. A multi-position valve, typically has one or more discrete settings between its fully open and fully closed positions. Another type of valve is a variable orifice sleeve valve that has an infinite number of open positions (i.e., a continuous range of movement exists) between its fully open and fully closed positions.

Challenges may arise in installing and operating valves in a subterranean well. More specifically, a valve may be controlled from the surface by an umbilical connection, such as a hydraulic control line or an electrical cable, for example. However, during the course of the well's lifetime, the umbilical connection may become damaged or may fail, thereby affecting control of the valve and possibly compromising the integrity of the well.

Thus, there is a continuing need for a system and/or technique to address one or more of the problems that are stated above. There is also a continuing need for a system and/or technique to address one or more potential problems that are not set forth above.

SUMMARY

In an embodiment of the invention, a technique that is usable with a subterranean well includes communicating a wireless stimulus downhole in the well and actuating a valve in response to the communication. The valve has more than one controllable open position.

Advantages and other features of the invention will become apparent from the following description, drawing and claims.

DETAILED DESCRIPTION

Figure 1:
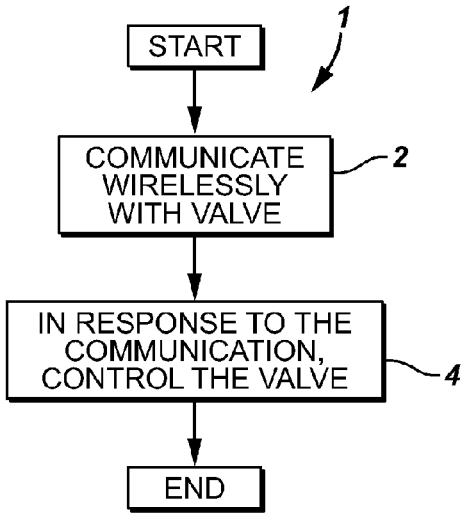
FIG. 1 is a flow diagram depicting a technique to operate a valve according to an embodiment of the invention.

Referring to FIG. 1, an embodiment 1 of a technique in accordance with the invention may be used for purposes of remotely actuating a valve that has multiple controllable open positions. In other words, the technique 1 may be used for purposes of wirelessly communicating with and operating a valve whose cross-sectional flow area is controllable to place the valve in its closed position or in one of its many open positions. Thus, the technique 1 may be used for purposes of operating a multi-position valve that has one or more discrete open settings between its fully open and fully closed positions, operating a variable orifice sleeve valve that has an infinite number of open settings between its fully open and fully closed positions, etc.

The technique 1 includes communicating wirelessly with the valve, as depicted in block 2 of FIG. 1. As described further below, this wireless communication includes the transmission of a wireless stimulus downhole for purposes of instructing the valve to close or open to some predetermined open position (for example, open position no. 2 for a multi-position valve or a 56% open position for a variable orifice sleeve valve). Depending on the particular embodiment of the invention, the wireless stimulus may be an electromagnetic wave that propagates through one or more subterranean formations to the valve; an acoustic wave that propagates downhole to the valve along a tubular string, such as a production tubing or a casing string; or a pressure pulse that propagates downhole through some fluid, such as the fluid in a production tubing or fluid in the well's annulus. Furthermore, the wireless stimulus may be one out of multiple wireless stimuli that are communicated downhole to operate the valve. Regardless of the form of the wireless stimulus, in response to this communication, the technique 1 includes actuating the valve, as depicted in block 4 of FIG. 1.

A potential advantage of the above-described technique is that, as compared to the actuation of conventional valves, a control umbilical, such as a hydraulic control line or an electrical cable (as examples), is not needed for the specific purpose of actuating the valve. Thus, the cost and complexity associated with the use of the valve are reduced, and reliability of the valve is increased. Other and different advantages may be possible, in other embodiments of the invention.

Figure 2:
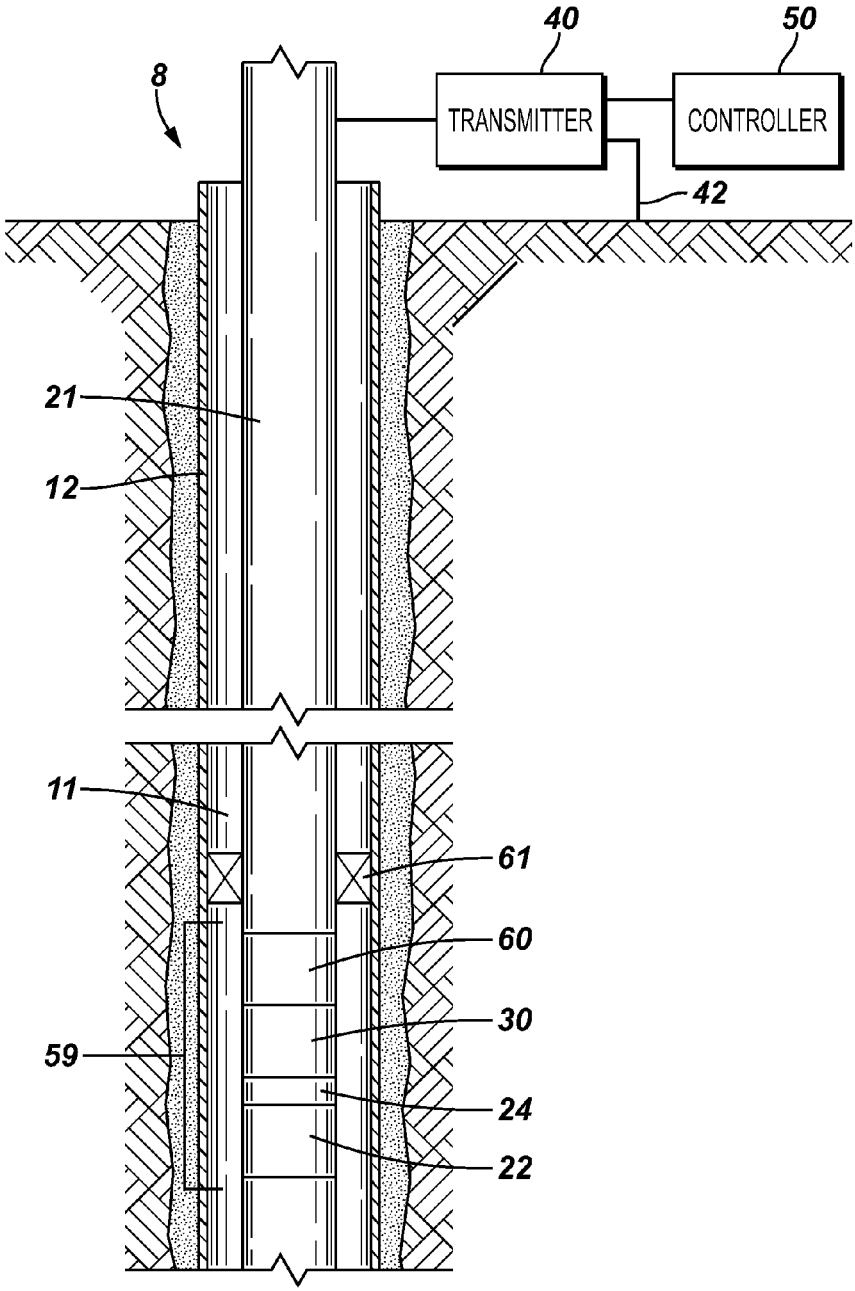
FIGS. 2, 5 and 8 are schematic diagrams of a subterranean well in accordance with different embodiments of the invention.

Referring to FIG. 2, as a more specific example, in some embodiments of the invention, a valve 59 may be part of a tubular string, such as a production string 21 (as an example), of a well 8. Although depicted in FIG. 2 as being located in a vertical wellbore of the well 8, it is understood that in other embodiments of the invention, the valve 59 may be located in a lateral wellbore and thus, may be part of a string that is deployed in the lateral wellbore, for example. Depending on the particular embodiment of the invention, the wellbore in which the valve 59 is located may either be a cased (as depicted in FIG. 2 showing a casing string 12) or uncased.

In some embodiments of the invention, the valve 59 includes receiver circuitry 60 that, as described further below, is constructed to receive a wireless stimuli that is transmitted to the valve 59 from a remote location relative to the valve 59. For example, in some embodiments of the invention, the wireless stimuli may be communicated from the surface of the well. In response to receipt of a recognized wireless stimulus, a controller 30 of the valve 59 operates an electrical motor 24 (of the valve) for purposes of controlling the valve's position in accordance to information that is encoded into the stimulus.

For example, in some embodiments of the invention, the controller 30 may recognize that the received wireless stimulus encodes a command to change the open position of the valve 59 so that the valve 59 is now sixty percent open instead of fifty percent open. As another example, the wireless stimulus may be encoded with a command to cause the valve 59 to change from a particular open position to a fully closed position. Other commands for the valve 59 are possible, depending on the particular embodiment of the invention.

The motor 24, in some embodiments of the invention, may be a stepper motor that is controlled by the controller 30 for purposes of positioning a sleeve 22. Depending on the particular embodiment of the invention, the sleeve 22 is concentric with the production tubing string 21 and is rotatably positioned to regulate the cross-sectional flow area through the valve 59. Although the valve 59 is described as including the sleeve 22 for purposes of controlling flow through the valve, it is understood that in other embodiments of the invention, other types of valves, such as a ball valve or a flapper valve, as examples, may be used. Furthermore, in other embodiments of the invention, the valve may include more than one sleeve whose position is controlled for purposes of regulating the overall cross-sectional flow area through the valve.

The well 8 includes an apparatus that is located at the surface of the well 8 for purposes of transmitting one or more wireless stimuli downhole to communicate with the valve 59. For example, as depicted in FIG. 2, in some embodiments of the invention, this apparatus may include a transmitter 40 that generates an electromagnetic signal that appears between an output terminal 43 (that is coupled to the production tubing string 21) of the transmitter 40 and a ground terminal 42 (that is coupled to the earth) of the transmitter 40. The transmitted electromagnetic signal propagates from the transmitter 40 downhole through one or more subterranean formation(s) to the valve 59.

The transmitter 40 may be coupled to a controller 50 (that may also be located at the surface of the well 8, for example) that controls the generation and signature of the electromagnetic wave, as well as selectively activates the transmitter 40 when transmission of the electromagnetic wave is desired. For example, in some embodiments of the invention, the controller 50 may activate the transmitter 40 for purposes of transmitting an electromagnetic wave to communicate a command downhole for purposes of controlling the cross-sectional flow area of the valve 59.

In some embodiments of the invention, for purposes of receiving the stimulus that is generated at the surface of the well, the production tubing 21 includes receiver circuitry 60 that may be integrated with (as an example) the production tubing string 21. Thus, in some embodiments of the invention, the receiver circuitry 60 may be part of the production tubing 21 and therefore, run downhole with the production tubing string 21. In other embodiments of the invention, the receiver circuitry 60 may be separate from the production tubing string 21.

For embodiments of the invention in which the transmitter 40 communicates an electromagnetic wave downhole, the receiver circuitry 60 may include a sensor and electronics to detect the electromagnetic wave and respond by communicating this information to the controller 30. The controller 30 analyzes the received waveforms to extract any command(s) for the valve 59. If a particular command is directed to changing the position of the valve 59 (i.e., the cross-sectional flow area of the valve 59) from its current position, the controller 30 controls the motor 24 to operate the sleeve 22 accordingly.

In some embodiments of the invention, the electromagnetic wave that is communicated downhole may be encoded with a particular command. This command may indicate a particular action to be performed, such as a command to completely close the valve, a command to set the valve at predetermined open position, a command to incrementally open or close the valve by a predetermined amount, a command to transition the valve to an absolute position, etc. The electromagnetic wave may also encode one or more parameters for the command. For example, for a variable orifice sleeve valve, a command may be directed to set the valve to an absolute position. An associated parameter may indicate the percentage of available cross-sectional flow area that should exist after the valve transitions to this position.

The electromagnetic wave may also be encoded with an address that specifically identifies the valve as well as possibly a subset of the valve that should respond to the command. Thus, one out of possible many remotely actuated valves, such as the valve 59, may be uniquely addressed and controlled. Thus, the transmitter 40 may generate wireless stimuli to control a plurality of valves, depending on the particular embodiment of the invention. Many other variations are possible in other embodiments of the invention.

Figure 3:
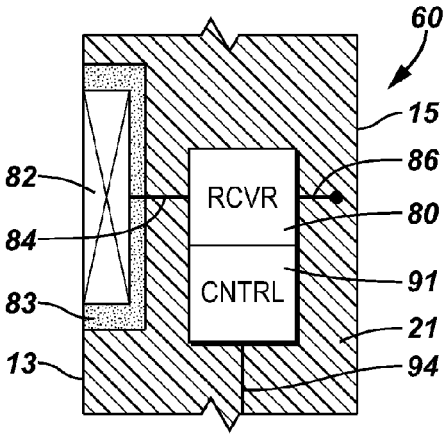
FIGS. 3 and 4 are schematic diagrams depicting downhole receiver circuitry according to different embodiments of the invention.

Referring also to FIG. 3, in embodiments of the invention in which electromagnetic waves are used to communicate with the valve 59, the receiver circuitry 60 may have a form that is depicted in FIG. 3. In this embodiment of the invention, the receiver circuitry 60 includes a receiver 80 that communicates (via a communication line 84) with an electromagnetic transducer 82. An outer face of the transducer 82 is exposed on an exterior surface 13 of the production tubing string 21. Furthermore, the transducer 82 is embedded in a dielectric material 83 for purposes of electrically isolating the transducer 82 from the conductive production tubing string 21. The receiver 80 also has a terminal 86 that is coupled to the production tubing string 21. Thus, via its connections to the production tubing 21 and to the transducer 82, the receiver circuitry 80 detects any electromagnetic wave that communicated by the transmitter 40.

In some embodiments of the invention, in addition to the transducer 82, the receiver circuitry 60 includes a controller 91 for purposes of extracting any command/address information from the wave. The controller 91, in response to recognizing a particular command for the valve, communicates (via one or more communication lines 94) with the controller 30 for purposes of operating the valve. In some embodiments of the invention, the controllers 30 and 91 may be merged into a single controller.

The inclusion of the transducer 82 near the exterior surface 13 of the production tubing string 21 provides one or more advantages. For example, such an arrangement benefits wireless telemetry systems that transmit signals through the earth in that the signal sent through the production tubing string to a location interior of the production tubing string may lose a substantial amount of strength as it passes through the string. Thus, this arrangement benefits the communication of wireless signals, such as electromagnetic signals and seismic signals that are communicated through the earth.

In some embodiments of the invention, the transducer 82 may electronically contact the casing string 12 and thus, may be exposed in a component of the production tubing string 21 that contacts the interior wall of the casing string 12. For example, in some embodiments of the invention, the transducer 82 may be located on the outer surface of a stabilizer fin of the production tubing 21. As another example, in some embodiments of the invention, the transducer 82 may be part of a packer (see FIG. 2) of the production tubing string 21. More specifically, in some embodiments of the invention, the transducer 82 may be located on or near an elastomer ring that expands to seal off an annulus 11 of the well 8. As another example, in some embodiments of the invention, the transducer 82 may be located on or near dogs (of the packer 61) that grip the interior wall of the casing string 12 for purposes of securing the packer 61 in place. Thus, many other variations are possible and are within the scope of the appended claims.

Figure 4:
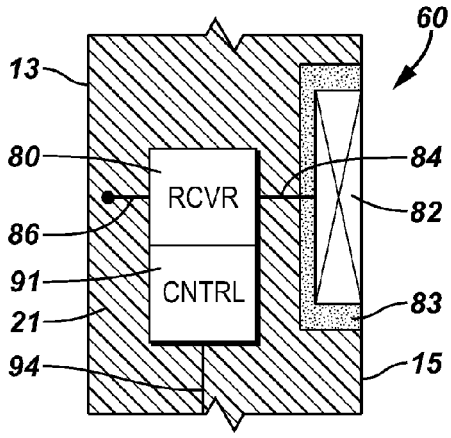

Referring to FIG. 4, in some embodiments of the invention, the transducer 82 may be located on an interior surface 15 of the production tubing string 21. In this embodiment of the invention, the transducer 82 is positioned to detect electromagnetic signals that appear inside the production tubing string 21. A particular advantage of this arrangement is that the transducer 82 may be better protected during the installation of the production tubing 21.

Although FIG. 2 depicts the communication of an electromagnetic wave, it is understood that in other embodiments of the invention, other wireless stimuli may be communicated downhole. For example, in some embodiments of invention, the transmitter 40 may be replaced by a mud pump for purposes of modulating a fluid pressure to communicate fluid pressure pulses (another form of wireless stimuli) downhole. This fluid pressure may be, for example, fluid in a production tubing, fluid in a well annulus or, etc. As another example, in other embodiments of the invention, the transmitter 40 may be replaced by a seismic stimulus generator that produces a force at the well's surface for purposes of communicating a seismic signal downhole. As yet another example, in some embodiments of the invention, the transmitter 40 may be replaced by an acoustic generator that communicates an acoustic signal downhole. For example, this acoustic signal may propagate along the well casing 12, the production tubing string 21, etc. Thus, the appended claims cover embodiments in which a wireless stimulus other than an electromagnetic wave is communicated downhole to actuate a valve.

Figure 5:
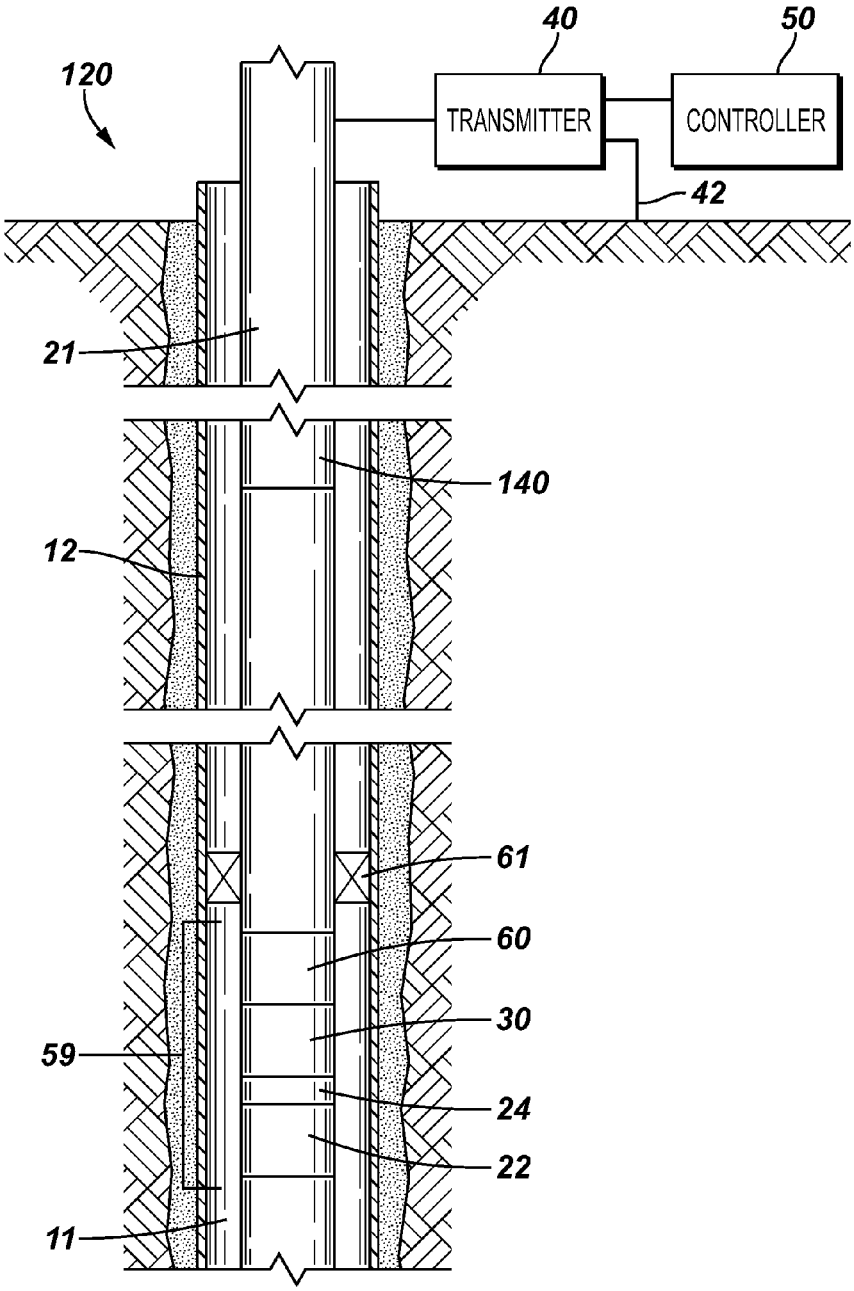
Figure 9:
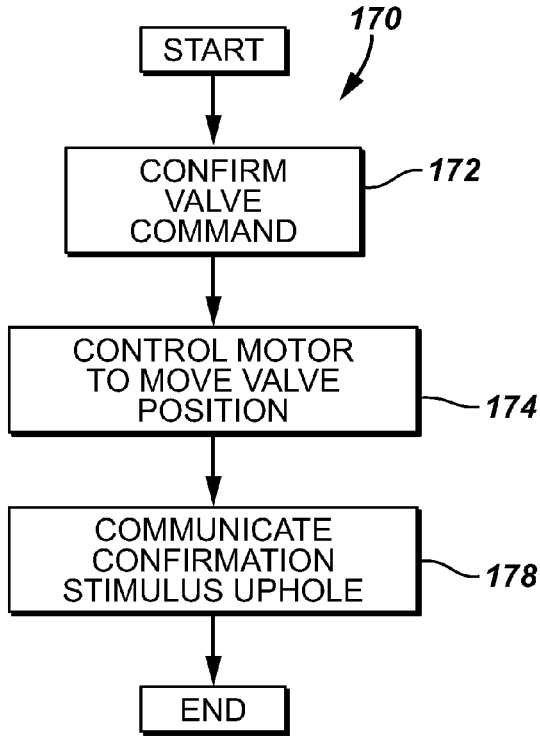
FIG. 9 is a flow diagram depicting a technique to actuate a valve according to an embodiment of the invention.

Referring to FIG. 5, in some embodiments of the invention, the transmitter that generates the wireless stimulus that is received by the receiver circuitry 60 may itself be located downhole. Thus, a system 120 may include a transmitter 140 that is located at some depth in the well for purposes of wirelessly communicating a stimulus to the receiver circuitry 60. A wired or wireless link may exist between the transmitter 140 and a surface transmitter 139 that communicates with the transmitter 140. The surface transmitter 139 is coupled to the controller 50. As a more specific example, in some embodiments of the invention, the transmitter 140 may include a transducer that is embedded in a dielectric medium in either the inner or outer surface of the production tubing 21 for purposes of communicating an electromagnetic signal to the receiver circuitry 60. Alternatively, the transmitter 140 may include one or more acoustic transducers for purposes of generating an acoustic signal on the well casing 12.

Many other arrangements are possible. For example, in some embodiments of the invention, the downhole transmitter may operate a particular downhole valve for purposes of modulating a fluid pressure that propagates to the receiver circuitry 60. Thus, other arrangements are within the scope of the appended claims.

Figure 6:
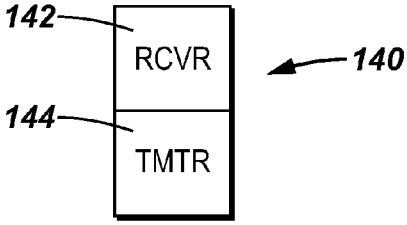
FIG. 6 is a block diagram of downhole transmitter circuitry according to an embodiment of the invention.

In some embodiments of the invention, the transmitter 140 may have a general form that is depicted in FIG. 6. As shown, the transmitter 140 includes a receiver section 142 for purposes of communicating with the surface transmitter 139 and a transmitter portion 144 for purposes of communicating the wireless stimulus to the receiver circuitry 60. Thus, in some embodiments of the invention, the transmitter 140 may effectively form a repeater to transmit a wireless stimulus in response to another stimulus (wired or wireless) that propagates from the surface of the well. For example, the processor in 154 may, upon recognizing a command for the valve, extract a parameter from the command indicating the relative or absolute position for the valve and control the motor 30 to position the valve accordingly.

Figure 7:
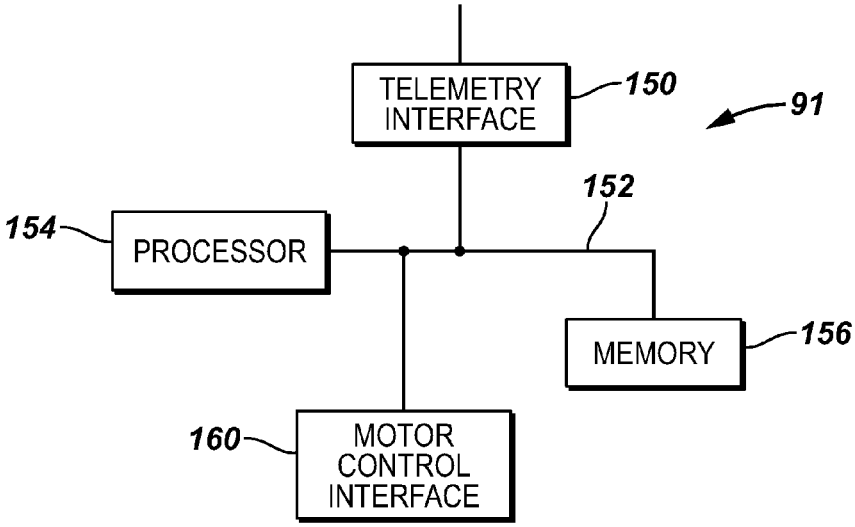
FIG. 7 is a block diagram of control circuitry of the receiver circuitry according to an embodiment of the invention.

In some embodiments of the invention, the controller 91 (see FIGS. 3 and 4, for example) of the receiver circuitry 60 may include circuitry similar to the circuitry that is depicted in FIG. 7. This circuitry includes a telemetry interface 150 for purposes of receiving signals from a transducer, bandpass filtering the signals and converting these signals into a digital form. The resulting digital signal may then be stored in a memory 156. The control circuitry 91 may include a processor 154 that processes the digital signal stored in the memory 156 for purposes of extracting any commands addresses and/or recognizing a signature of the digital signal.

Figure 8:
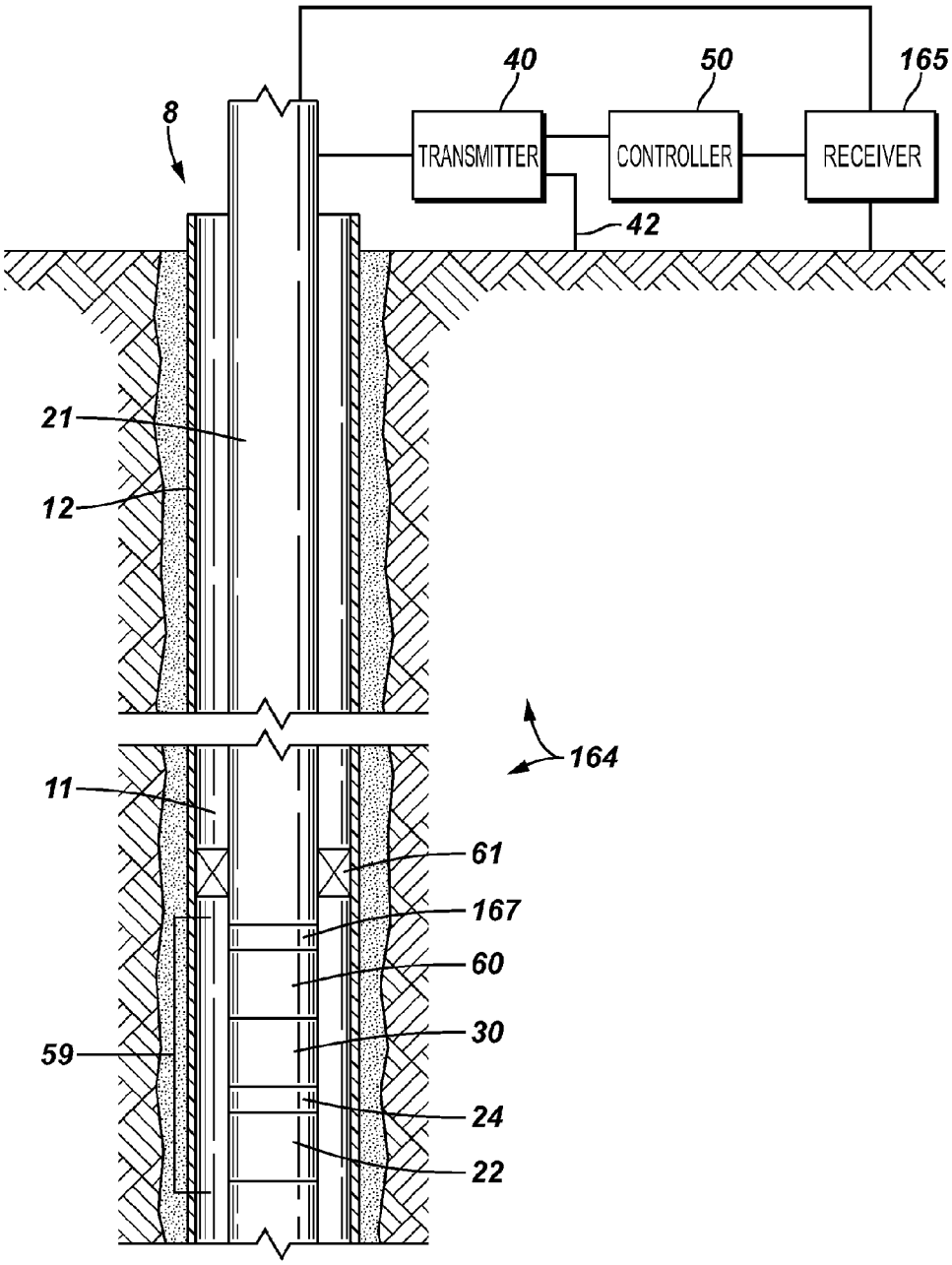

Referring to FIG. 8, in some embodiments of the invention, the systems described above may be replaced by a system 164. The system 164 may, for example, have a similar design to the system that is depicted in FIG. 2, except that the system 164 includes a downhole transmitter 167. As an example, this transmitter 167 may be integrated with and thus installed with the casing string 12. The transmitter 167 is located near the receiver circuitry 60. As an example, the transmitter 167 may be wirelessly or wiredly connected to the receiver circuitry 60.

The purpose of the transmitter 167 is to communicate a stimulus (a wireless or wired stimulus, depending on the particular embodiment of the invention) uphole for such purposes of acknowledging that the valve has been operated in accordance with the command and for indicating the position of a moveable element (a sleeve, for example) of the valve, as just a few examples. In some embodiments of the invention, the transmitter 167 may be operated by the receiver circuitry 60 (such as by the processor of the receiver circuitry 60) to communicate a stimulus uphole to indicate actuation of the valve in response to the command.

As a more specific example, in some embodiments of the invention, the transmitter 167 may be an electromagnetic wave transmitter to communicate an electromagnetic wave to the surface to be detected by a receiver circuit 165 at the surface of the well. As another example, the transmitter 167 may be an acoustic transmitter or may control a particular valve in the well for purposes of propagating a fluid pressure pulse(s) uphole to indicate operation of the valve. These pulse(s) are detected at the surface by pressure pulse sensor(s) and electronics (not shown). Thus, many other possible embodiments are within the scope of the appended claims.

Thus, in accordance with an embodiment of the invention, the receiver circuitry 60 may perform a technique similar to a technique 170. Pursuant to the technique 170, the receiver circuitry 60 confirms a command that is communicated from the surface and directed to operate the valve, as depicted in block 172. After this confirmation, the receiver circuitry 60 communicates (block 174) with the motor 24 to operate the valve so that the valve assumes the desired position. After this occurrence, the receiver circuitry 60 interacts with the transmitter 167 to communication a confirmation stimulus uphole, as depicted in block 178.

Other embodiments are within the scope of the following claims. For example, in some embodiments of the invention, the valve 59 may be run downhole on conveyance devices (coiled tubing, wireline, slick line, etc.) other than a production tubing string.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A method usable with a well, comprising:

communicating a wireless stimulus in the well, the wireless stimulus being indicative of a command;

actuating a multi-position valve in response to the communication, the valve having more than one controllable open position;

confirming downhole in the well whether the valve has operated in accordance with the command; and acknowledging whether the valve has been operated in accordance with the command, comprising using a transducer for the valve that is located proximate to an exterior surface of downhole production tubing to communicate another wireless stimulus from the valve uphole to identify that the operation of the valve has been confirmed downhole.

2. The method of claim 1, wherein the actuating comprises communicating with a variable orifice sleeve valve.

3. The method of claim 1, further comprising:

communicating said wireless stimulus to the surface of the well.

4. The method of claim 1, wherein said another wireless signal is indicative of a position of the valve.

5. The method of claim 1, wherein the communicating comprises:

transmitting an electromagnetic wave from the surface of the well through at least one subterranean formation.

6. The method of claim 1, wherein the communicating comprises:

communicating a seismic wave from the surface of the well through at least one subterranean formation.

7. The method of claim 1, wherein the communicating comprises:

communicating an acoustic wave downhole.

8. The method of claim 7, further comprising:

communicating the acoustic wave on a tubular string.

9. The method of claim 1, wherein the communicating comprises:

communicating a pressure pulse downhole.

10. The method of claim 9, further comprising:

communicating the pressure pulse through at least one of a fluid in the production tubing or a fluid in an annulus.

11. The method of claim 1, further comprising:

encoding the stimulus to indicate a command; and decoding the stimulus near the tool to extract the command.

12. A system usable with a well, comprising:

a multi-position valve located downhole in the well, the valve having more than one controllable open position;

an apparatus to communicate a wireless stimulus to the tool to actuate the valve, the wireless stimulus being indicative of a command;

a transducer located proximate to an exterior surface of production tubing comprising the valve; and a circuit located downhole to confirm the command, operate the valve in accordance with the command, and use the transducer to communicate another wireless stimulus uphole to acknowledge that the valve has been operated in accordance with the command to identify that the circuit confirmed the command.

13. The system of claim 12, wherein the valve comprises a variable orifice sleeve valve.

14. The system of claim 12, wherein the valve is adapted to communicate said another wireless stimulus to the surface of the well.

15. The system of claim 12, wherein said another wireless stimulus indicates a position of the valve.

16. The system of claim 12, wherein the apparatus is adapted to transmit an electromagnetic wave from the surface to the valve through at least one subterranean formation.

17. The system of claim 12, wherein the apparatus is adapted to communicate a seismic wave from the surface through at least one subterranean formation.

18. The system of claim 12, wherein the apparatus is adapted to communicate an acoustic wave downhole to actuate the valve.

19. The system of claim 18, wherein said apparatus is further adapted to communicate the acoustic wave using a tubular string.

20. The system of claim 12, where the apparatus is adapted to communicate a pressure pulse downhole to actuate the valve.

21. The system of claim 20, wherein the apparatus is further adapted to communicate the pressure pulse through one of a fluid in the production tubing and a fluid in an annulus.

22. The system of claim 12, wherein the apparatus is further adapted to:

encode the stimulus to indicate a command, and decode the stimulus near the tool to extract the command.

23. A method usable with a well, comprising:

communicating a wireless stimulus in the well, the wireless stimulus being indicative of a command;

actuating a multi-position valve in response to the communication, the valve having more than one controllable open position;

confirming downhole in the well whether the valve has operated in accordance with the command; and acknowledging whether the valve has been operated in accordance with the command, comprising using a transducer for the valve that is located proximate to an interior surface of downhole production tubing to communicate another wireless stimulus from the valve uphole to identify that the operation of the valve has been confirmed downhole.

24. A system usable with a well, comprising:

a multi-position valve located downhole in the well, the valve having more than one controllable open position;

an apparatus to communicate a wireless stimulus to the tool to actuate the valve, the wireless stimulus being indicative of a command;

a transducer located proximate to an interior surface of production tubing comprising the valve; and a circuit located downhole to confirm the command, operate the valve in accordance with the command, and use the transducer to communicate another wireless stimulus uphole to acknowledge that the valve has been operated in accordance with the command to identify that the circuit confirmed the command.

* * * * *